US011038306B2

(12) United States Patent
Cannon

(10) Patent No.: US 11,038,306 B2
(45) Date of Patent: Jun. 15, 2021

(54) POWER PLUG RETENTION DEVICE

(71) Applicant: Microsoft Technology Licensing, LLC, Redmond, WA (US)

(72) Inventor: Lawrence Dale Cannon, Bothell, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 248 days.

(21) Appl. No.: 16/384,713

(22) Filed: Apr. 15, 2019

(65) Prior Publication Data

US 2020/0328559 A1 Oct. 15, 2020

(51) Int. Cl.
*H01R 13/639* (2006.01)
*H01R 13/58* (2006.01)
*H01R 24/38* (2011.01)

(52) U.S. Cl.
CPC ..... *H01R 13/6395* (2013.01); *H01R 13/5804* (2013.01); *H01R 13/6392* (2013.01); *H01R 24/38* (2013.01)

(58) Field of Classification Search
None
See application file for complete search history.

(56) References Cited

U.S. PATENT DOCUMENTS 4,121,880 A * 10/1978 Rollins ..... H01R 13/6395 24/16 PB
6,997,734 B1 2/2006 McQuirter
7,056,145 B2 6/2006 Campbel et al.
7,722,380 B1 5/2010 West et al.
7,963,792 B2 6/2011 Sawada et al.
9,692,178 B2 6/2017 Hutchison et al.
2008/0299824 A1 12/2008 Legg
2013/0183855 A1* 7/2013 Warner ..... H01R 13/6395 439/536
2014/0357096 A1 12/2014 Kuo et al.
(Continued)

FOREIGN PATENT DOCUMENTS

EP 3078080 A1 10/2016
WO 2017058200 A1 4/2017

OTHER PUBLICATIONS

"Install AC Power Cord Retention Clips", Retrieved from: https://docs.oracle.com/cd/E19815-01/E22980-02/z400000b1341791.html, Retrieved Date: Sep. 6, 2018, 1 Page.
(Continued)

*Primary Examiner* — James Harvey
(74) *Attorney, Agent, or Firm* — Alleman Hall Creasman & Tuttle LLP

(57) ABSTRACT

A power plug retention device for use with a power plug inserted in a power receptacle is provided. The power plug retention device includes a body including an insertion portion and a gripping portion formed along an insertion axis of the body. The insertion portion is shaped as a wedge configured to be inserted in a gap between the power plug and the power receptacle. The gripping portion includes an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

20 Claims, 10 Drawing Sheets

(56) References Cited

U.S. PATENT DOCUMENTS

2018/0087770 A1* 3/2018 Cannon ..... F21V 33/0084
2020/0328559 A1* 10/2020 Cannon ..... H01R 24/38

OTHER PUBLICATIONS

"Plug Mate (pack of 4), makes it easier to remove plugs from sockets and includes picture labels to identify the appliance at the end of the wire!", Retrieved from: https://web.archive.org/web/20160304031721/https://www.amazon.co.uk/easier-sockets-picture-identify-appliance/dp/B005GO1YKK, Aug. 10, 2011, 4 Pages.
"Plug Pulls", Retrieved from: https://web.archive.org/web/20160828133304/https:/www.oakvillecarecentre.co.uk/contents/en-us/d181_plug-pull.html, Aug. 28, 2016, 2 Pages.
"Power Outlet Unit Power Cords and Plug Retention Device", Retrieved from: https://media.digikey.com/pdf/Data%20Sheets/Panduit%20PDFs/Power_Outlet,Cord,Plug_Spec.pdf, Aug. 2009, 2 Pages.
"Tripp Lite PDU Plug Lock Connector C20 Power Cord to C19 Outlet Black 100PK", Retrieved from: https://www.cdw.com/product/tripp-lite-pdu-plug-lock-connector-c20-power-cord-to-c19-outlet-black-100pk/3070677, Retrieved Date: Sep. 6, 2018, 2 Pages.
"Tripp Lite PDU Plug Lock Connector C14 Power Cord to C13 Outlet Blue 100PK", Retrieved from <<https://www.cdw.com/product/tripp-lite-pdu-plug-lock-connector-c14-power-cord-to-c13-outlet-blue-100pk/3070680>>, Retrieved Date: Mar. 26, 2019, 2 Pages.
"International Search Report and Written Opinion issued in PCT Application No. PCT/US20/024800", dated Jul. 10, 2020, 11 Pages.

* cited by examiner

POWER PLUG RETENTION DEVICE

BACKGROUND

Many electronic devices, such as computer devices, use power plug assemblies to couple the electronic device to a power source. Typically, in these power plug assemblies, when the plug on the power cord is plugged into a recessed receptacle of the power plug assembly, the plug may potentially be vibrated or accidentally be pulled loose causing power to the electronic device to be lost.

SUMMARY

A power plug retention device for use with a power plug inserted in a power receptacle is provided. The power plug retention device may comprise a body including an insertion portion and a gripping portion formed along an insertion axis of the body. The insertion portion may be shaped as a wedge configured to be inserted in a gap between the power plug and the power receptacle. The gripping portion may include an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Typical solutions use open-ended sleeves that are fit around the end of the plug of the power cord before the plug is inserted into the power receptacle. However, these sleeves can make it difficult for a user to push the plug all the way into the receptacle to fully seat the plug, which may cause insufficient contact between the plug and receptacle contacts. The insufficient contact may potentially cause the contacts to overheat, potentially causing an electrical hazard. Additionally, these sleeves than make it difficult for the user to remove the plug from the receptacle, and typically cause the user to have to pull on the cord of the power plug during removal, which may potentially cause damage to the power cord.

Figure 1:
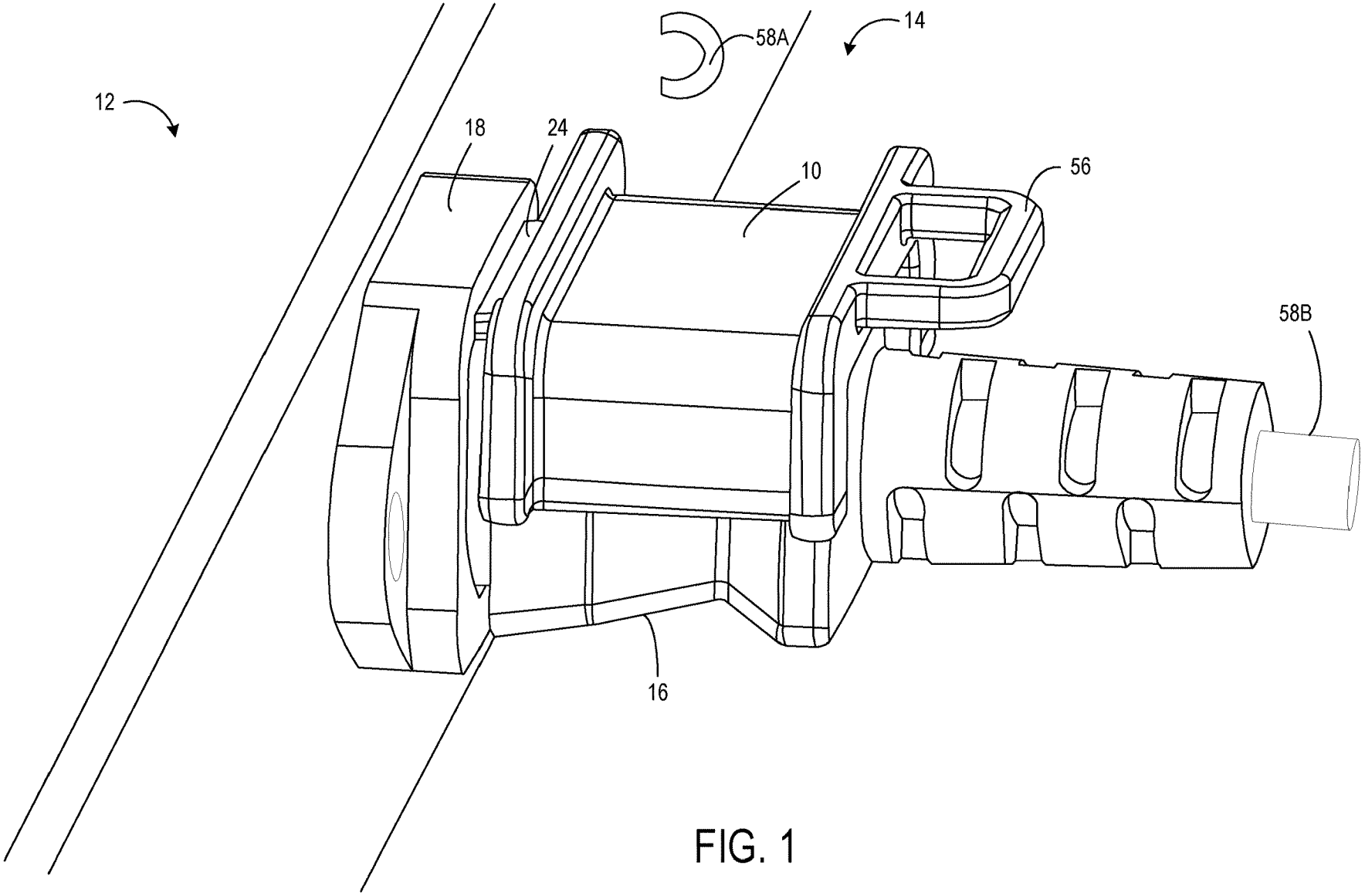
FIG. 1 shows an example power plug assembly including a power plug retention device according to one embodiment of the present disclosure.

To address these issues, FIG. 1 illustrates an example power plug retention device 10 that is designed to help prevent power cords from being accidentally unplugged or worked loose via vibration from their power receptacles. The power plug retention device 10 is configured to be both insertable and removeable from a power plug assembly while the power plug is inserted into the power receptacle. FIG. 1 illustrates an example electronic device 12 that includes a power plug assembly 14 for the electronic device 12. The electronic device 12 may take any suitable form, such as, for example, a server device, a desktop computer device, a speaker device, or any other type of electronic device that includes the power plug assembly 14. In one example, the power plug assembly of the electronic device 12 includes a power plug 16 and a power receptacle 18.

Figure 2:
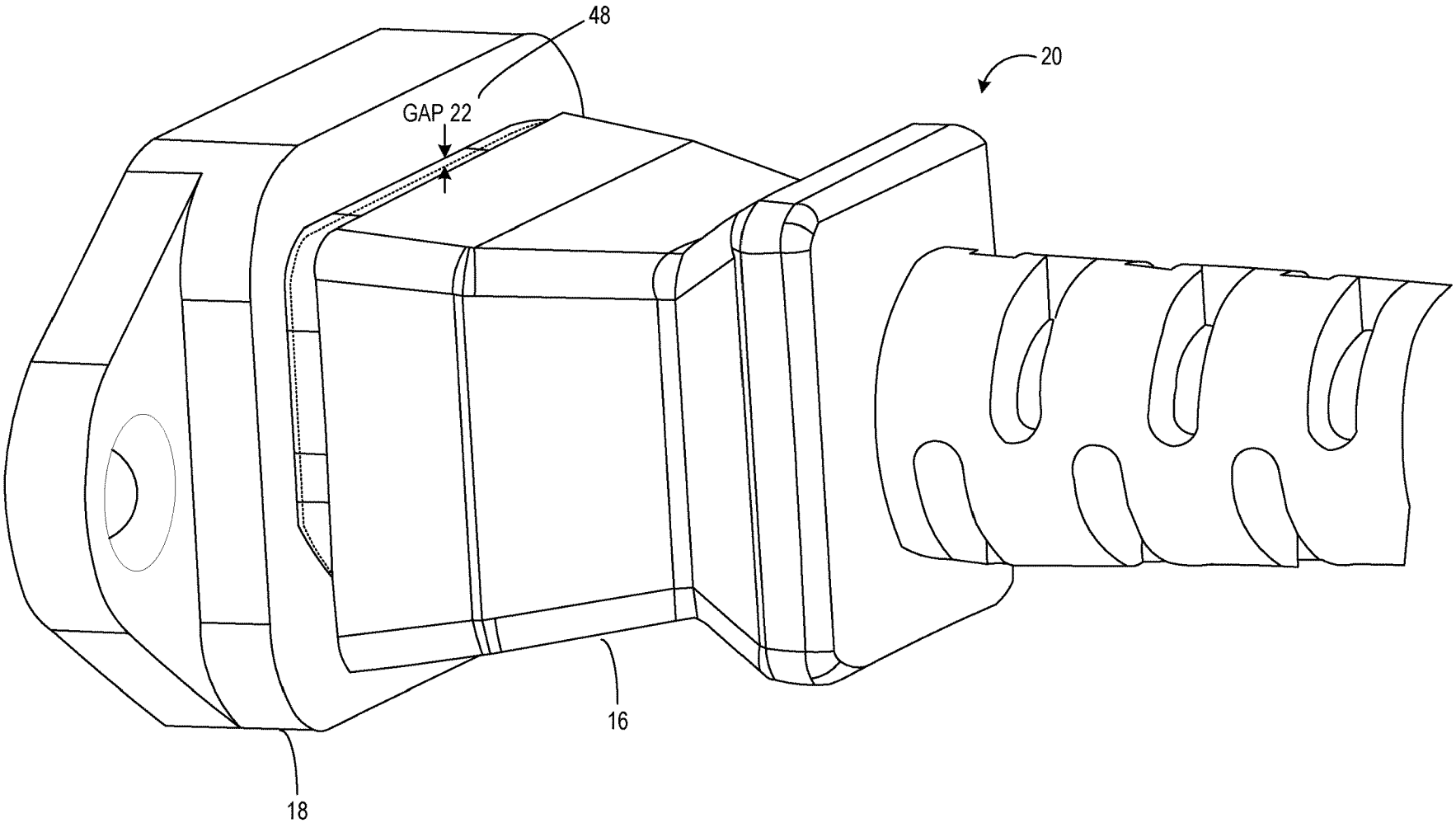
FIG. 2 shows an example power plug inserted into an example power plug receptacle of the power plug assembly of FIG. 1.

FIG. 2 illustrates a close-up view of the example power plug assembly before insertion of the power plug retention device 10. Typically, when the power plug 16 of the power cord 20 is inserted into the power receptacle 18, there is a gap 22 between an inside surface of the power receptacle and an outside surface of the power plug 16. Additionally, the power receptacle 18 is typically formed out of a hard plastic, and the power plug 16 is typically formed out of a vinyl material that is softer and more elastic than the hard plastic of the power receptacle 18. As will be described in more detail below, an insertion portion of the power plug retention device 10 may be inserted and lodged into the gap 22 to form an interference/friction fit with the head of the power plug 16 and the inside surface of the power receptacle 18. As illustrated in FIG. 1, the insertion portion 24 power plug retention device 10 may be inserted into the gap 22 while the power plug 16 is already inserted into the power receptacle 18.

In one example, the power plug retention device 10 may be formed out of a glass strand filled nylon material. More particularly, the material may include 25-30% glass strand, and 70-75% nylon 66. However, it should be appreciated that other materials and proportions may be used to form the power plug retention device 10. As will be described below, the power plug retention device 10 further includes other structures to aid in the insertion and removal of the insertion portion 24 into/out of the gap 22 between the power plug 16 and the power receptacle 18.

Figure 3:
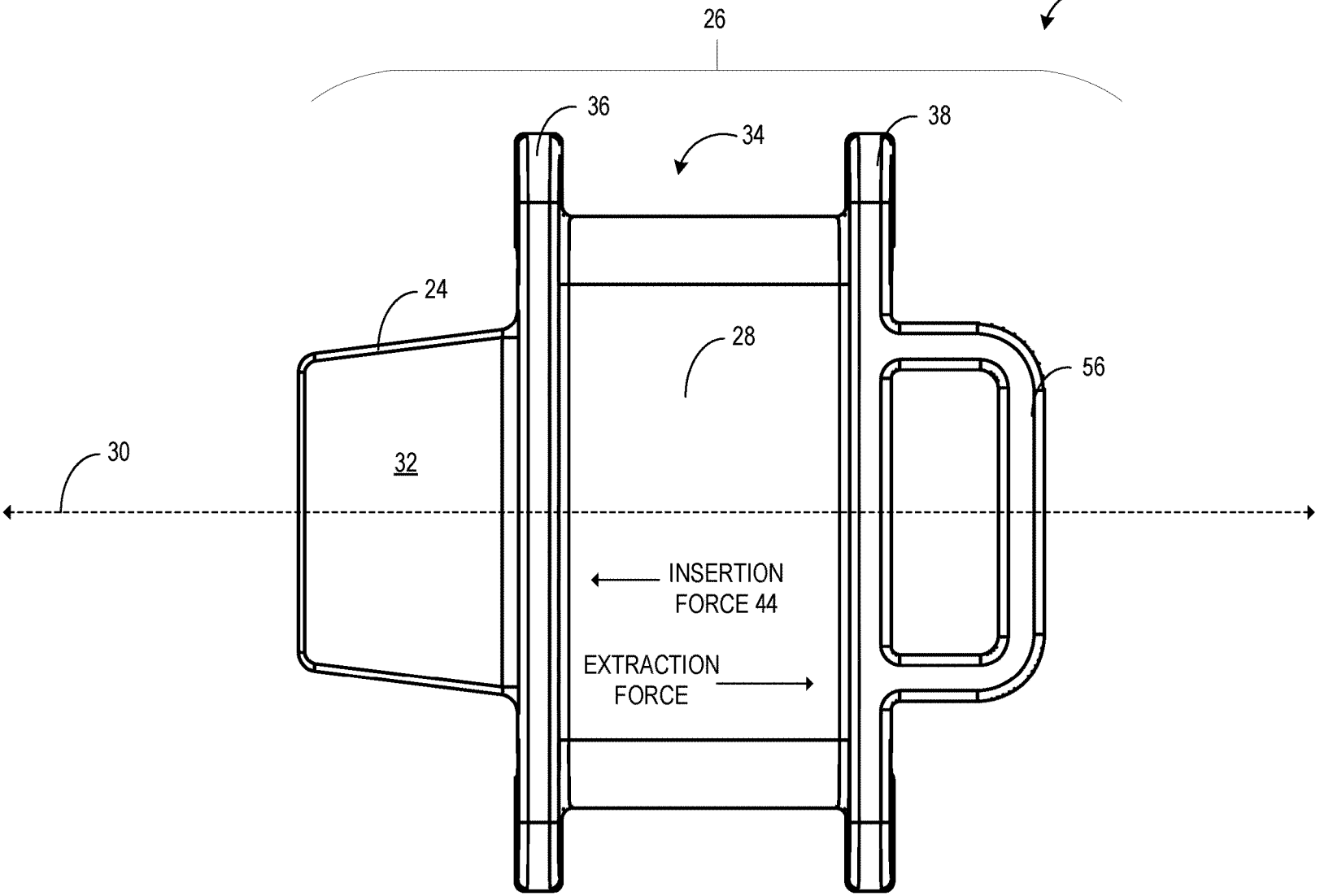
FIG. 3 shows an overhead view of a first embodiment of the power plug retention device of FIG. 1.

FIG. 3 illustrates an overhead view of a first embodiment of the power plug retention device 10 for use with a power plug 16 inserted in a power receptacle 18. As shown, the power plug retention device 10 may include a body 26 including an insertion portion 24 and a gripping portion 28 formed along an insertion axis 30 of the body 26. The insertion axis 30 may be defined by a direction of a force that is applied to the power plug retention device 10 to insert or extract the insertion portion 24 into/out of the gap 22. In the illustrated example, the insertion portion 24 may be shaped as a wedge 32 configured to be inserted in the gap 22 between the power plug 16 and the power receptacle 18. Due to the wedge shape, the insertion portion 24 may be inserted into the gap 22 between the power plug 16 and the power receptacle 18 while the power plug 16 is plugged into the power receptacle 18 until a suitable degree of friction/interference fit is established to help prevent the power plug 16 from being accidentally pulled out and/or worked loose via vibration.

The gripping portion 28 may include a channel 34 formed in the body 26. The channel 34 may be formed to be sized for a user's fingers. That is, the user may insert their fingers into the channel 34, and grip the power plug retention device 10 via surfaces of the gripping portion 28. As illustrated, the channel may be defined by a first wall 36, a second wall 38, and surfaces of the gripping portion 28 that extend between the first wall 36 and the second wall 38. The channel may be formed to be orthogonal to the insertion axis 30 of the power plug retention device 10. That is, a direction of the channel defined as extending between two openings of the channel 34 may be orthogonal to the insertion axis 30. Similarly, the first wall 36 and second wall 38 may also extend orthogonally to the insertion axis 30.

Figure 4:
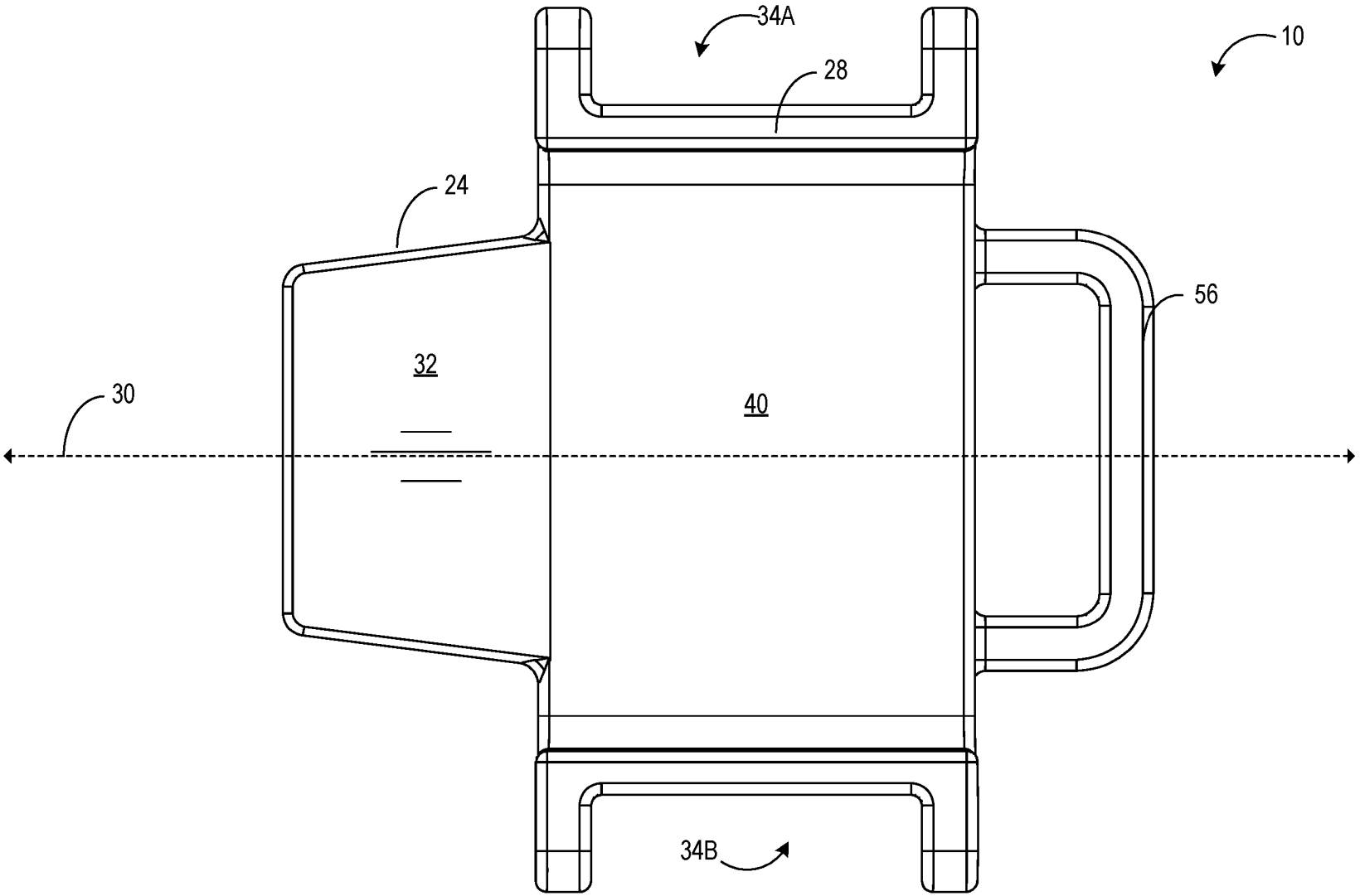
FIG. 4 shows a bottom view of the first embodiment of the power plug retention device of FIG. 1.

FIG. 4 illustrates a bottom view of the first embodiment of the power plug retention device 10. In the illustrated example, the channel 34 of the gripping portion 28 is formed to have a downward facing U-shape with at least two opposing channel portions 34A and 34B formed around a space 40 sized to fit the power plug 16. The two opposing channel portions 34A and 34B extend downward from the power plug retention device 10 and form the two wings of a "U" shape. An open space 40 extends between the two opposing channel portions 34A 34B. The two opposing channel portions 34A are sized and positioned relative to each other such that the space 40 extending between the two opposing channel portions 34A and 34B is sized to fit the power plug 16. As illustrated in FIG. 1, the power plug 16 fits inside the space 40 extending between the "U" shaped channel 34 of the power plug retention device 10, thus allowing the power plug retention device 10 to securely rest on top of the power plug 16.

Figure 5:
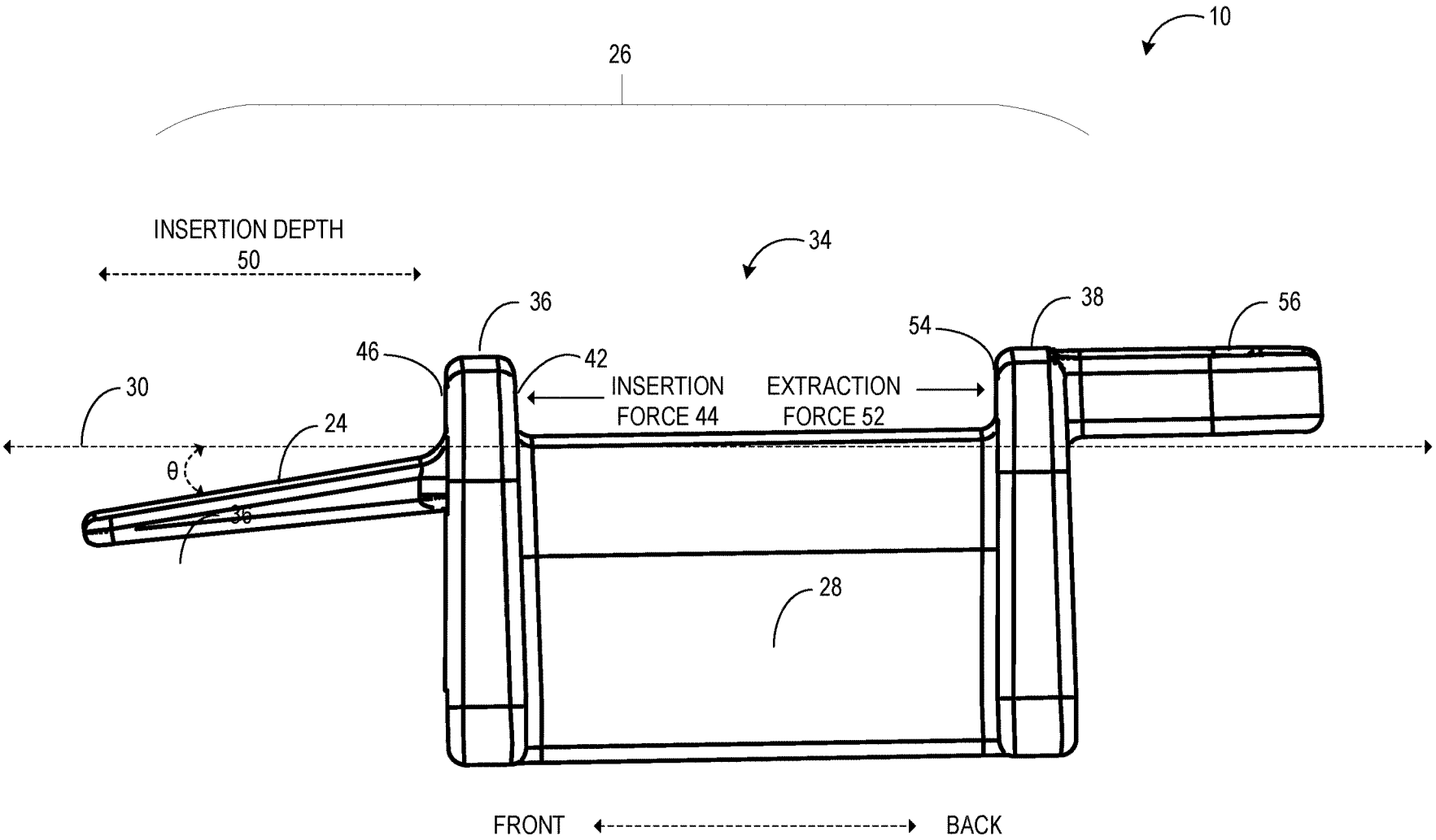
FIG. 5 shows a side view of the first embodiment of the power plug retention device of FIG. 1.

FIG. 5 illustrates a side view of the first embodiment of the power plug retention device 10. As shown, the insertion portion 24, which may take the form of a wedge, extends in the direction of the insertion axis 30. In one example, the insertion portion 24 may be further formed to point downwards at an angle θ from the insertion axis 30. In one example, the downward angle may be between 10 to 20 degrees from the insertion axis 30. However, it should be appreciated that other suitable downward angle ranges may be used, such as, for example, 5 to 10 degrees, 15 to 30 degrees, etc. The downward angle θ may help guide the insertion portion 24 into the gap 22 between the power plug 16 and the power receptacle 18.

Additionally, the gripping portion 28 may include an insertion force receiving surface 42 formed orthogonal to the insertion axis 30. The insertion force receiving surface 42 may be configured to receive an insertion force 44 from a user in an insertion direction along the insertion axis 30 to thereby insert and lodge the wedge 32 in the gap 22 to form an interference fit between the wedge 32, the power plug 16, and the power receptacle 18 when the wedge 32 is inserted in the gap 22. The insertion force 44 may be applied by the user's fingers that are resting in the channel 34 by pushing against the insertion force receiving surface 42. In the first embodiment, the insertion force receiving surface 42 may be formed on a back portion of the first wall 36, with "front" and "back" being defined relative to the insertion axis 30, with the insertion portion 24 being formed on a "front" of the power plug retention device 10.

The first embodiment of the power plug retention device 10 may further include a stopping surface 46 configured to contact an outer surface 48 of the power receptacle 18 to stop ingress of the power plug retention device 10 into the power receptacle 18 at a predetermined insertion depth 50. As shown, the stopping surface 46 extends outward from the power plug retention device 10 such that the stopping surface 46 will contact the outer surface 48 of the power receptacle 18 illustrated in FIG. 2 when the power plug retention device 10 is fully inserted.

In the first embodiment of the power plug retention device 10, the stopping surface 46 is formed as a front portion of the first wall 36 defining the channel 34. As illustrated, the first wall 36 is positioned behind the insertion portion 24, and is formed orthogonal to the insertion axis 30. As shown, the position of the first wall 36 may further be defined as being positioned between the insertion portion 24 and the gripping portion 28 of the body 26. In the first embodiment, the insertion force receiving surface 42 and the stopping surface 46 are formed as two opposite sides of the first wall 36, such that an insertion force 44 may be applied to the insertion force receiving surface 42 until the stopping surface 46 contacts the outer surface 48 of the power receptacle 18 and ingress of the insertion portion 24 into the gap 22 is stopped.

After the first embodiment of the power plug retention device 10 has been inserted into the gap 22, it may be configured to be extracted via an extraction force 52 applied to an extraction force receiving surface 54. In the first embodiment, the extraction force receiving surface 54 may be formed as a front portion of the second wall 38 of the channel 34. That is, to remove the power plug retention device 10, the user may place their fingers into the channel 34 and grip the surfaces of the gripping portion 28. Then, by pulling, the user's fingers may apply an extraction force 52 to the extraction force receiving surface 54 which will pull the insertion portion 24 out of the gap 22 between the power plug 16 and the power receptacle 18. In this manner, it should be appreciated that the power plug retention device 10 may be both inserted and extracted from the gap 22 while the power plug 16 is inserted into the power receptacle 18. However, it should further be appreciated that the power plug retention device 10 may also be inserted into the power receptacle 18 at the same time as the power plug 16 to form the friction/interference fit.

As illustrated in FIGS. 3, 4, and 5, the power plug retention device 10 may further include an attachment portion 56 configured to removably attach the power plug retention device 10 to an attachment surface 58. In the first embodiment, the attachment portion 56 may take the form of a loop mount that may be removably attached via a fastening cord, such as, for example, cord, string, zip ties, etc.

The attachment portion 56 may be fastened to any suitable attachment surface 58. In the example illustrated in FIG. 1, the attachment portion 56 in the form of a loop mount may be fastened to an attachment surface 58A located on the electronic device 12. In another example, the attachment portion 56 may be fastened to an attachment surface 58B in the form of the cord of the power plug 16. By using the attachment portion 56, the power plug retention device 10 may be configured to be removably attached to the cable of the power plug 16 while the power plug 16 is plugged into the power receptacle 18. On the other hand, the power plug retention device 10 may also be removably attached before the power plug 16 has been plugged into the power receptacle 18. Removably attaching the power plug retention device 10 to the attachment surface 58 may help prevent loss of the power plug retention device 10 by a user. It should be appreciated that the power plug retention device 10 may be removably attached to any suitable type of attachment surface 58.

Figure 6:
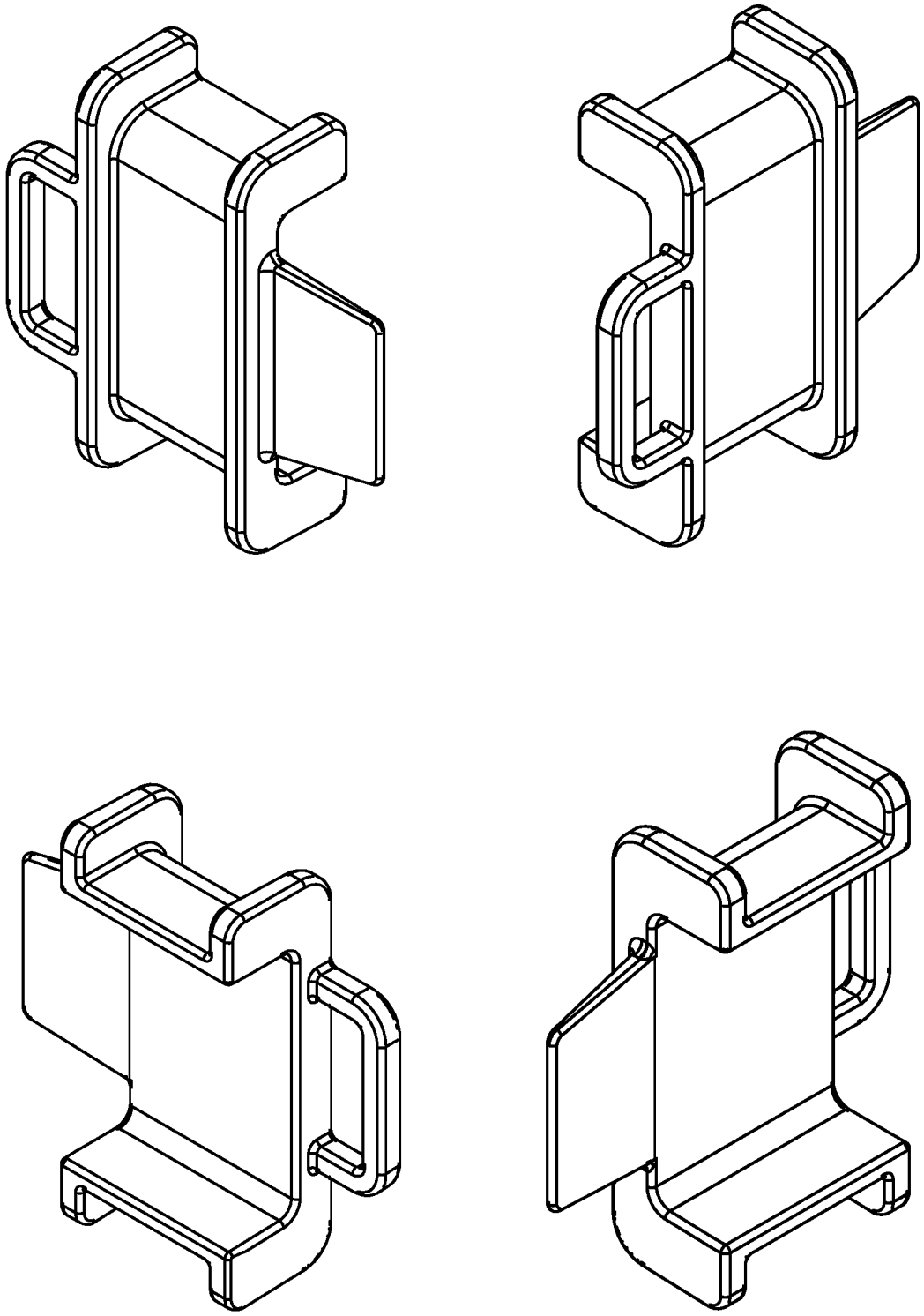
FIG. 6 shows four different views of the first embodiment of the power plug retention device of FIG. 1.

FIG. 6 illustrates several different views of the first embodiment of the power plug retention device 10. The downward facing U-shape of the channel portions 34 of the gripping portion 28 is shown from several different angles in FIG. 6.

Figure 7:
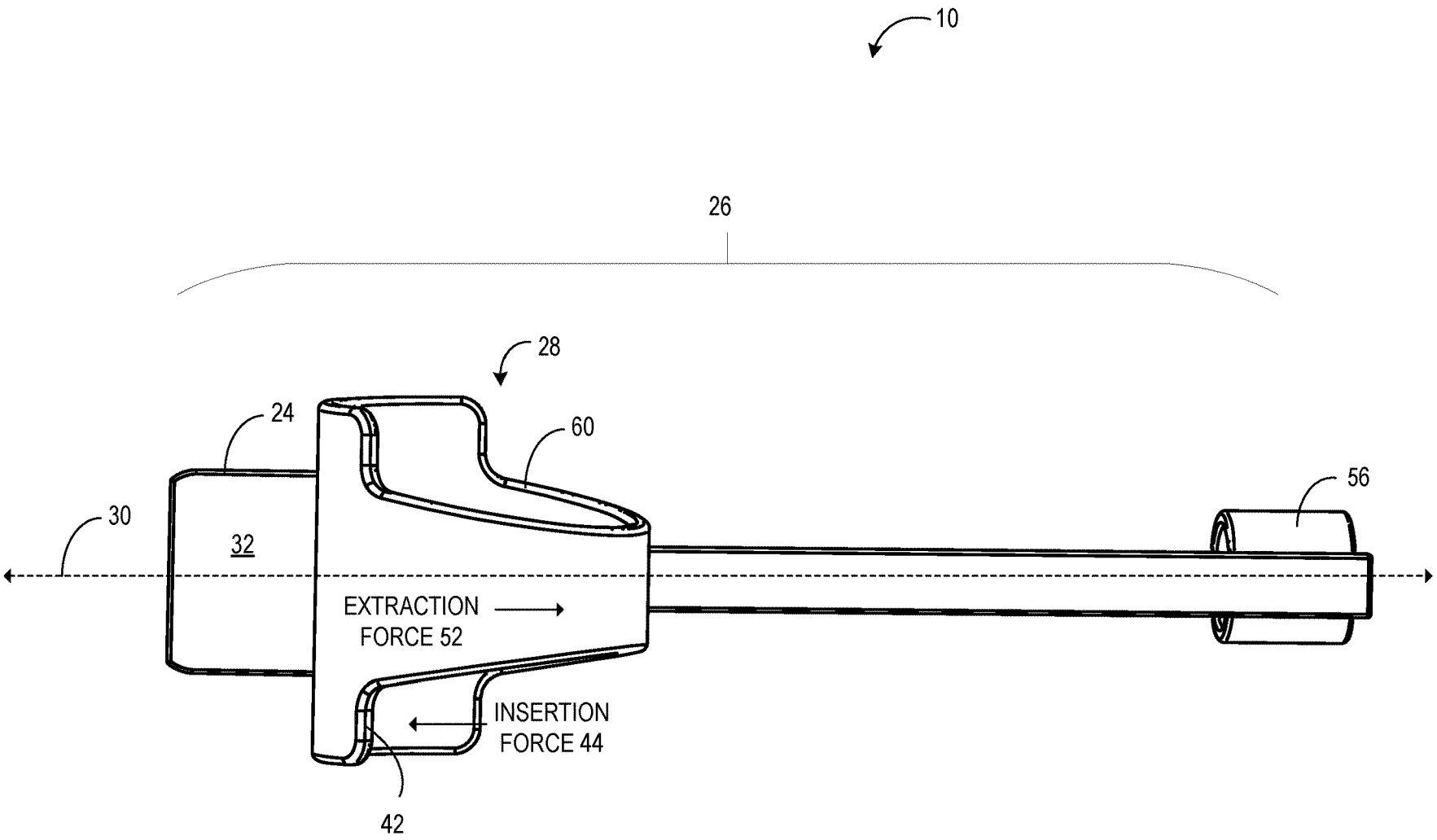
FIG. 7 shows an overhead view of a second embodiment of the power plug retention device of FIG. 1.

FIG. 7 illustrates an overhead view of a second embodiment of the power plug retention device 10. As illustrated, the second embodiment also includes the body 26 including the insertion portion 24 and the gripping portion 28 formed along the insertion axis 30 of the body 26. Similarly to the first embodiment, the insertion portion 24 may be shaped as a wedge 32 configured to be inserted in the gap 22 between the power plug 16 and the power receptacle 18. The second embodiment of the power plug retention device 10 also include the attachment portion 56.

As illustrated, in the second embodiment, rather than a channel, the gripping portion 28 may include a loop structure 60 having openings that face orthogonal to the insertion axis 30. That is, the curving surfaces of the loop structure 60 curve along the insertion axis 30, and the openings of the loop structure open in a direction that is orthogonal to the insertion axis 30. To grip the power plug retention device 10, the user may insert their fingers into the loop structure 60 and grip the surfaces of the loop structure.

To insert the insertion portion 24 into the gap, the user may then apply an insertion force 44 to the insertion force receiving surface 42. For example, while the user's fingers are inserted into the loop structure 60, then user may press their finger's forward against the insertion force receiving surface 42 to push the insertion portion 24 into the gap 22. In the second embodiment of the power plug retention device 10, the insertion force receiving surface 42 may be formed on an inside surface of the loop structure 60. In some examples, the insertion force receiving surface 42 may further include extended surfaces that extend outward from the loop structure 60 in a direction that is orthogonal to the insertion axis 30 to provide greater surface area for the user to push on.

Figure 8:
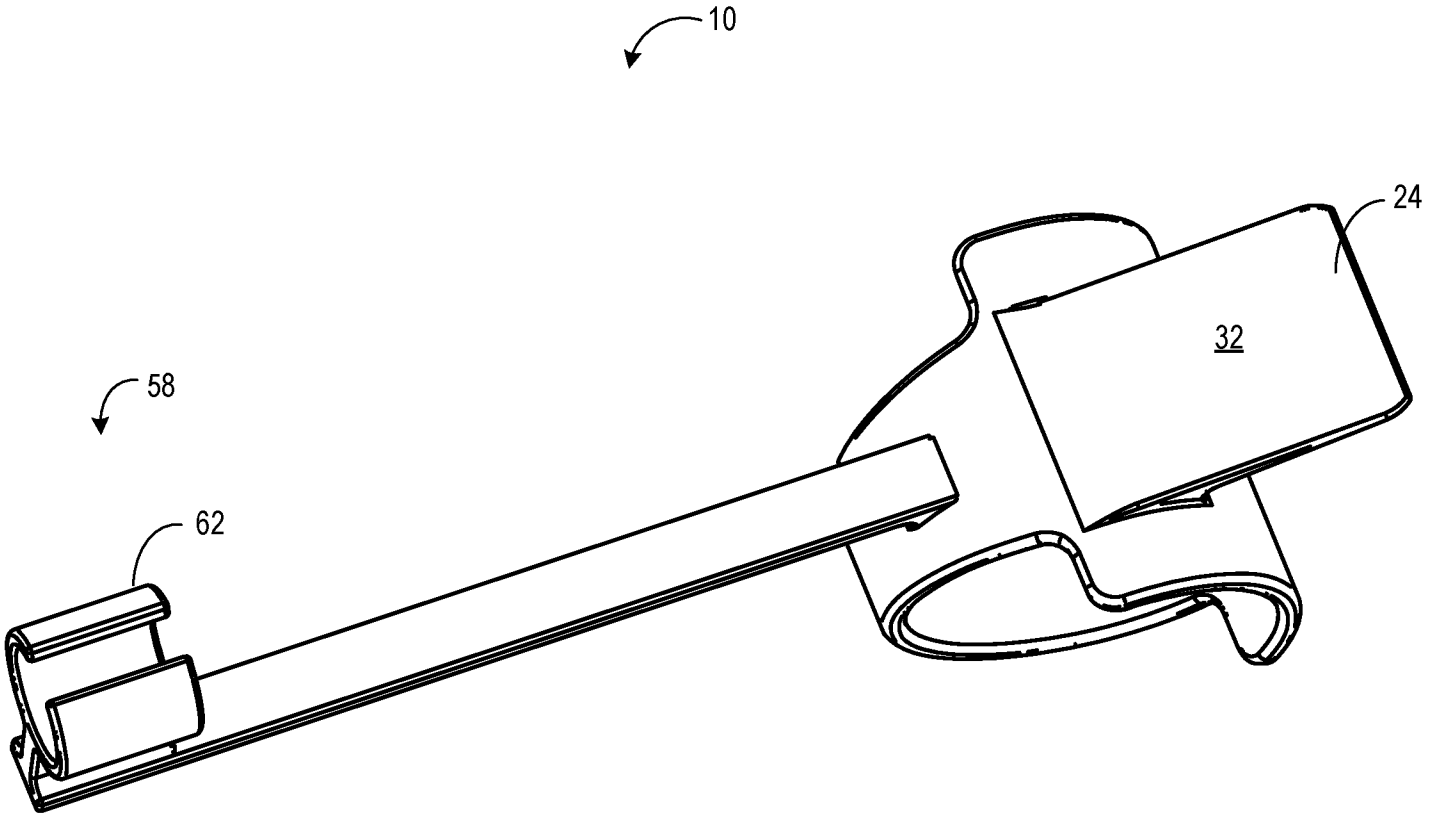
FIG. 8 shows a bottom view of the second embodiment of the power plug retention device of FIG. 1.

FIG. 8 illustrates a bottom view of the second embodiment of the power plug retention device 10. As shown, the attachment portion 56 of the second embodiment may take the form of a clip device 62 configured to fasten to the cable of the power plug 16. The clip device 62 may be formed out of a spring and/or flexible material that is sized to fit around the cable of the power plug 16. The clip device 62 may be removably attached to the cable via pressing the clip device 62 onto the cable until the clip device 62 fastens around the cable. It should be appreciated that in this manner, the clip device 62 may be attached and removed from the cable of the power plug 16 while the power plug 16 is already plugged into the power receptacle 18.

Figure 9:
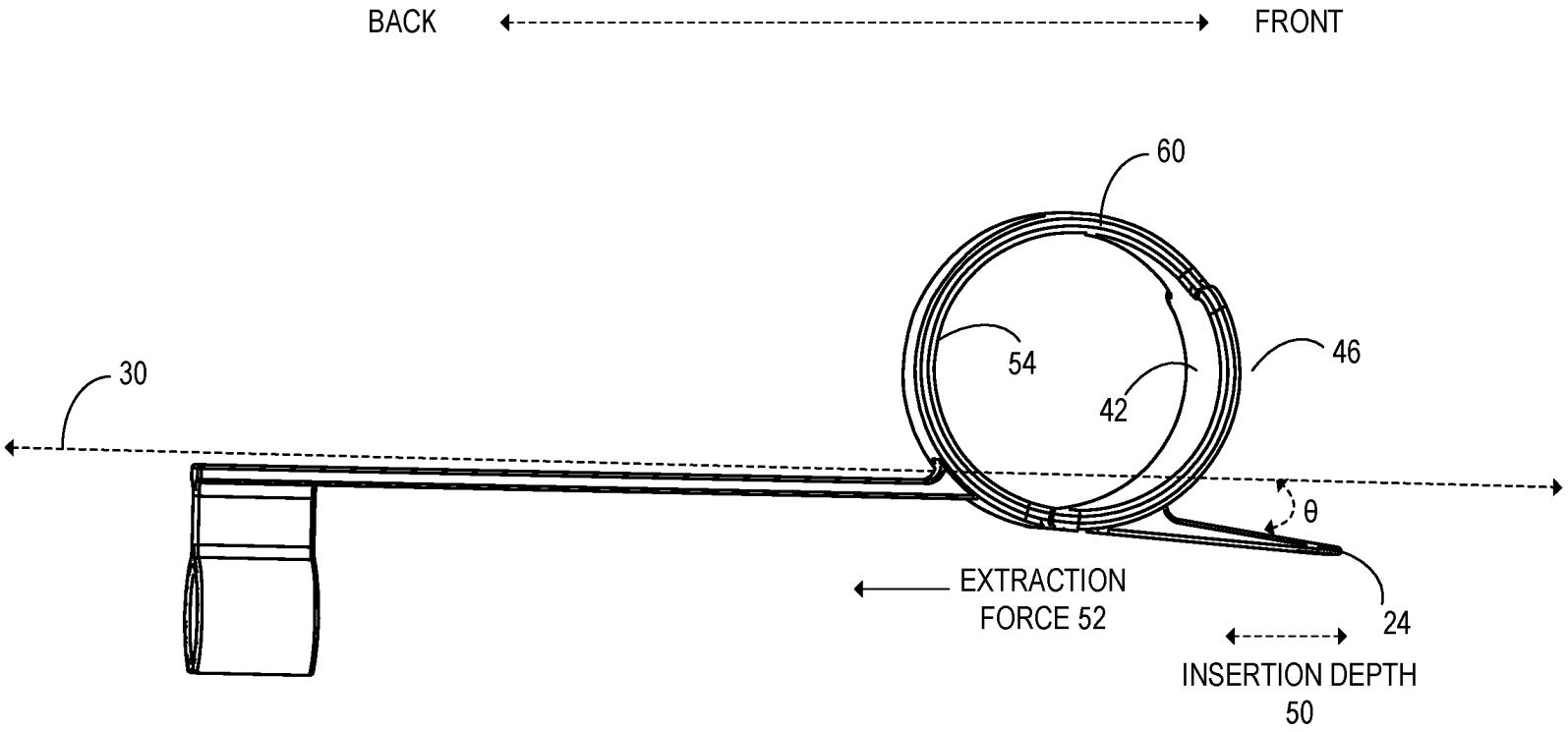
FIG. 9 shows a side view of the second embodiment of the power plug retention device of FIG. 1.

FIG. 9 illustrates a side view of the second embodiment of the power plug retention device 10. As discussed above, the insertion portion 24, which may take the form of a wedge, extends in the direction of the insertion axis 30. In one example, the insertion portion 24 may be further formed to point downwards at an angle θ from the insertion axis 30. In one example, the downward angle may be between 10 to 20 degrees from the insertion axis 30. However, it should be appreciated that other suitable downward angle ranges may be used, such as, for example, 5 to 10 degrees, 15 to 30 degrees, etc. The power plug retention device 10 may further include a stopping surface 46 formed on a surface of the loop structure 60 facing the insertion portion 24. As described above, the stopping surface is configured to contact an outer surface 48 of the power receptacle 18 to stop ingress of the power plug retention device 10 into the power receptacle 18 at a predetermined insertion depth 50. In one example, the stopping surface 46 may take the form of a wall surface that is formed on the front side of the loop structure 60. As illustrated, the stopping surface 46 and the insertion force receiving surface 42 may be positioned on opposite sides of a front curved surface of the loop structure 60.

Figure 10:
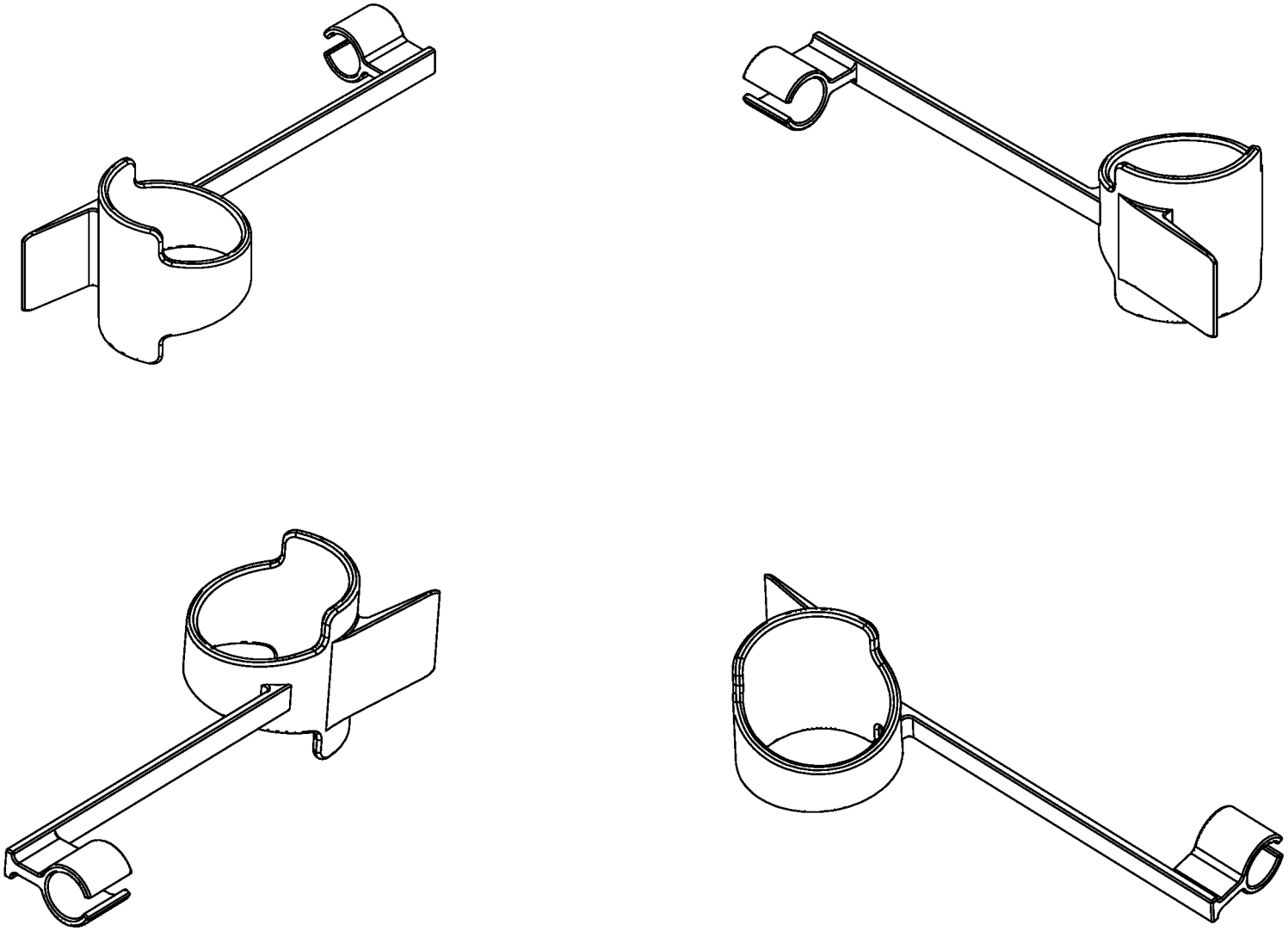
FIG. 10 shows four different views of the second embodiment of the power plug retention device of FIG. 1.

In one example, the user may extract the second embodiment of the power plug retention device 10 from the power receptacle 18 by inserting fingers into the loop structure 60 and pulling to apply an extraction force 52 to an extraction force receiving surface 54. The extraction force receiving surface 54 may be located on a back curved surface of the loop structure 60. In this manner, it should be appreciated that the second embodiment of the power plug retention device 10 may be inserted and removed while the power plug 16 is inserted into the power receptacle 18. FIG. 10 illustrates several different views of the second embodiment of the power plug retention device.

In the example power plug retention devices 10 illustrated in FIGS. 1-10, the wedge is shown as being inserted into a gap between a top of the power plug and a top of the power receptacle. However, it should be appreciated that in some examples, gaps may also be present between each side of the power plug and power receptacle. The insertion portion 24, which may take the form of a wedge, may be positioned and orientated on the power plug retention device 10 to be inserted into any of these gaps. For example, the wedge may be orientated vertically such that the wedge may be inserted into vertical gaps located between a left and right side of the power plug and the power receptacle.

Additionally, while the power plug retention devices 10 have been illustrated as resting on top of the power plug 16, it should be appreciated that the power plug retention devices 10 may be configured to secure to other positions on the power plug 16. For example, the power plug retention device may be configured to be attached to a left or right side of the power plug. As another example, the power plug retention device 10 may be configured to secure to a bottom side of the power plug 16, and the insertion portion 24 may be configured to be inserted into a gap between a bottom of the power plug 16 and a bottom of the power receptacle.

Further, it should be appreciated that the dimensions of the power plug retention device 10 may be configured to 1 U form factors. For example, the power plug retention device 10 may be configured to fit into a server rack having a height dimension that is set based on the 1 U form factor. For example, the power plug retention device 10 may be sized such that the power plug retention device 10 does not extend above a height of the server device when the power plug retention device 10 is inserted into the power assembly of that server device.

In the examples described herein and illustrated in FIGS. 1-10, the gripping surface 28 has been describe as taking the form of a channel or a loop structure. However, it should be appreciated that other structures may be used to perform the described functions of the gripping surface, insertion force receiving surface, and the extraction force receiving surface. For example, the gripping surface may take the form of a single wall, tab, or another type of protrusion that may be gripped by a user. As another example, the gripping surface 28 may take the form of indents sized to fit a user's fingers. The surfaces of the indents may server as the insertion and extraction receiving surfaces. As yet another example, the gripping surface 28 may take the form of a friction surface that facilitates the user's grip of the power plug retention device 18, and the user may apply an insertion force and extraction force to the friction surface. It should be appreciated that the gripping surface 28 is not limited to the forms described herein, but may take any suitable form.

The following paragraphs provide additional support for the claims of the subject application. One aspect provides a power plug retention device for use with a power plug inserted in a power receptacle. The power plug retention device comprises a body including an insertion portion and a gripping portion formed along an insertion axis of the body. The insertion portion is shaped as a wedge configured to be inserted in a gap between the power plug and the power receptacle. The gripping portion includes an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap. In this aspect, additionally or alternatively, the wedge may be configured to be inserted into the gap between the power plug and the receptacle while the power plug is plugged into the power receptacle. In this aspect, additionally or alternatively, the power plug retention device may further include a stopping surface configured to contact an outer surface of the power receptacle to stop ingress of the power plug retention device into the power receptacle at a predetermined insertion depth. In this aspect, additionally or alternatively, the stopping surface may be a front portion of a wall positioned behind the insertion portion, the wall being formed orthogonal to the insertion axis. In this aspect, additionally or alternatively, the insertion force receiving surface may be a back portion of the wall. In this aspect, additionally or alternatively, the gripping portion may include channel formed in the body, the channel being sized for a user's fingers. In this aspect, additionally or alternatively, the insertion force receiving surface may be a back portion of a first wall of the channel, the first wall being positioned between the insertion portion and the gripping portion of the body. In this aspect, additionally or alternatively, the power plug retention device may further include an extraction force receiving surface that may be a front portion of a second wall of the channel. In this aspect, additionally or alternatively, the channel may be formed orthogonal to the insertion axis. In this aspect, additionally or alternatively, the gripping portion may include a loop structure having openings that face orthogonal to the insertion axis. In this aspect, additionally or alternatively, the power plug retention device may further include a stopping surface formed on a surface of the loop structure facing the insertion portion, the stopping surface being configured to contact an outer surface of the power receptacle to stop ingress of the power plug retention device into the power receptacle at a predetermined insertion depth. In this aspect, additionally or alternatively, the power plug retention device may include an attachment portion configured to removably attach the power plug retention device to an attachment surface. In this aspect, additionally or alternatively, the attachment portion may be configured to be removably attached to a cable of the power plug while the power plug is plugged into the power receptacle. In this aspect, additionally or alternatively, the attachment portion may be a clip device configured to fasten to the cable of the power plug. In this aspect, additionally or alternatively, the attachment portion may be configured to be removably attached via a fastening cord. In this aspect, additionally or alternatively, the wedge may be formed to extend in a downward angle from the insertion axis. In this aspect, additionally or alternatively, the downward angle may be 10 to 20 degrees from the insertion axis.

Another aspect provides a power plug retention device for use with a power plug inserted in a power receptacle. The power plug retention device may comprise a body including an insertion portion and a gripping portion formed along an insertion axis of the body. The insertion portion is shaped as a wedge configured to be inserted in a gap between the power plug and the power receptacle. The gripping portion includes a channel that is sized for a user's fingers formed in the body, the channel having a downward facing U-shape with at least two opposing channel portions formed around a space sized to fit the power plug. The gripping portion includes an insertion force receiving surface formed on a wall defining the channel that is orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap. In this aspect, additionally or alternatively, the downward facing U-shape of the channel may be configured to fit around and rest on top of the power plug when the wedge is inserted in the gap.

Another aspect provides a power plug assembly for an electronic device comprising a power plug, a power receptacle, and a power plug retention device for use with the power plug inserted in the power receptacle. The power plug retention device comprises a body including an insertion portion and a gripping portion formed along an insertion axis of the body. The insertion portion is shaped as a wedge configured to be inserted in a gap between the power plug and the power receptacle. The gripping portion includes an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A power plug retention device for use with a power plug inserted in a power receptacle, the power plug retention device comprising:

a body including an insertion portion and a gripping portion formed along an insertion axis of the body;

wherein the insertion portion is shaped as a wedge configured to be inserted in a gap between the power plug and the power receptacle; and wherein the gripping portion includes an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

2. The power plug retention device of claim 1, wherein the wedge is configured to be inserted into the gap between the power plug and the receptacle while the power plug is plugged into the power receptacle.

3. The power plug retention device of claim 1, further comprising a stopping surface configured to contact an outer surface of the power receptacle to stop ingress of the power plug retention device into the power receptacle at a predetermined insertion depth.

4. The power plug retention device of claim 3, wherein the stopping surface is a front portion of a wall positioned behind the insertion portion, the wall being formed orthogonal to the insertion axis.

5. The power plug retention device of claim 4, wherein the insertion force receiving surface is a back portion of the wall.

6. The power plug retention device of claim 1, wherein the gripping portion includes a channel formed in the body, the channel being sized for a user's fingers.

7. The power plug retention device of claim 6, wherein the insertion force receiving surface is a back portion of a first wall of the channel, the first wall being positioned between the insertion portion and the gripping portion of the body.

8. The power plug retention device of claim 7, wherein an extraction force receiving surface is a front portion of a second wall of the channel.

9. The power plug retention device of claim 6, wherein the channel is formed orthogonal to the insertion axis.

10. The power plug retention device of claim 1, wherein the gripping portion includes a loop structure having openings that face orthogonal to the insertion axis.

11. The power plug retention device of claim 10, further comprising a stopping surface formed on a surface of the loop structure facing the insertion portion, the stopping surface being configured to contact an outer surface of the power receptacle to stop ingress of the power plug retention device into the power receptacle at a predetermined insertion depth.

12. The power plug retention device of claim 1, further comprising an attachment portion configured to removably attach the power plug retention device to an attachment surface.

13. The power plug retention device of claim 12, wherein the attachment portion is configured to be removably attached to a cable of the power plug while the power plug is plugged into the power receptacle.

14. The power plug retention device of claim 13, wherein the attachment portion is a clip device configured to fasten to the cable of the power plug.

15. The power plug retention device of claim 12, wherein the attachment portion is configured to be removably attached via a fastening cord.

16. The power plug retention device of claim 1, wherein the wedge is formed to extend in a downward angle from the insertion axis.

17. The power plug retention device of claim 16, wherein the downward angle is 10 to 20 degrees from the insertion axis.

18. A power plug retention device for use with a power plug inserted in a power receptacle, the power plug retention device comprising:

a body including an insertion portion and a gripping portion formed along an insertion axis of the body;

wherein the insertion portion is shaped as a wedge configured to be inserted in a gap between the power plug and the power receptacle;

wherein the gripping portion includes a channel that is sized for a user's fingers formed in the body, the channel having a downward facing U-shape with at least two opposing channel portions formed around a space sized to fit the power plug; and wherein the gripping portion includes an insertion force receiving surface formed on a wall defining the channel that is orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

19. The power plug retention device of claim 18, wherein the downward facing U-shape of the channel is configured to fit around and rest on top of the power plug when the wedge is inserted in the gap.

20. A power plug assembly for an electronic device comprising:

a power plug;

a power receptacle; and a power plug retention device for use with the power plug inserted in the power receptacle, the power plug retention device comprising:

a body including an insertion portion and a gripping portion formed along an insertion axis of the body;

wherein the insertion portion is shaped as a wedge configured to be inserted in a gap between the power plug and the power receptacle; and wherein the gripping portion includes an insertion force receiving surface formed orthogonal to the insertion axis and configured to receive an insertion force from a user in an insertion direction along the insertion axis to thereby insert and lodge the wedge in the gap to form an interference fit between the wedge, the power plug, and the power receptacle when the wedge is inserted in the gap.

* * * * *